US005992405A

United States Patent [19]

Sollami

[11] Patent Number: 5,992,405

[45] Date of Patent: Nov. 30, 1999

[54] TOOL MOUNTING FOR A CUTTING TOOL

[75] Inventor: Phillip A. Sollami, Herrin, Ill.

[73] Assignee: The Sollami Company, Herrin, Ill.

[21] Appl. No.: 09/002,518

[22] Filed: Jan. 2, 1998

[51] Int. Cl.[6] ..... B28D 5/04

[52] U.S. Cl. ..... 125/36; 125/40; 241/195; 411/134

[58] Field of Search ..... 125/36, 40; 175/414, 175/420.1, 426, 428, 432, 389, 390; 411/134, 144, 149, 432, 533; 241/195, 197

[56] References Cited

U.S. PATENT DOCUMENTS

| | | | |
|---|---|---|---|
| 4,344,581 | 8/1982 | Redenann | 241/195 X |
| 5,190,423 | 3/1993 | Ewing . | |
| 5,314,279 | 5/1994 | Ewing . | |
| 5,507,441 | 4/1996 | De Boef et al. | 241/195 X |

*Primary Examiner*—Timothy V. Eley
*Attorney, Agent, or Firm*—Robert L. Marsh

[57] ABSTRACT

A tool mounting block having a forward surface and a rearward surface and a cylindrical transverse aperture extending therethrough opening onto both the forward and rearward surfaces. The tool has a tapered forward cutting end, and axially aligned behind the forward cutting end is an annular flange. Axially aligned behind the annular flange is a cylindrical mounting portion adapted to sidably fit within a complementarily cylindrical aperture of the mounting block, and extending rearward of the cylindrical mounting portion is a threaded stud. At the forward end of the tapered cutting end is a seat into which a hardened metal insert is bonded. To retain the cylindrical mounting portion of the tool within the cylindrical aperture of the mounting block, a locking nut assembly is threaded on the stud. When a tool is retained in a mounting block by such a nut assembly, the nut may be tightened to prevent rotation of the tool within the mounting block. An anti-rotation device may be provided between the block and the tool in the form of a ridge or a groove on the forward surface of the block which is engaged by a complementary ridge or groove on the inner surface of an annular flange of the tool.

19 Claims, 4 Drawing Sheets

TOOL MOUNTING FOR A CUTTING TOOL

The present invention relates to the mounting of cutting tools on a machine, and in particular to a method and apparatus for removably mounting such tools thereon, and for protecting an anti-rotation device for such a tool from being worn away.

BACKGROUND OF THE INVENTION

Machines which cut hard surfaces, such as concrete and asphalt and the like, have a rotating cutting element with a plurality of cutting tools mounted thereon. During the operation of the machine, each of the cutting elements is brought in contact with the hard surface to remove a small portion of the material and thereby advance the cut. The cutting tools for such machines are symmetrical about a longitudinal axis and have a forward cutting end into which a hardened tungsten carbide insert is fitted, and a rearward cylindrical mounting end which is retained in a mounting block of the machine. While the tools for certain machines are adapted to rotate within the mounting block, other cutting tools are non-rotatably mounted in the block. Presently, the non-rotatably mounted tools have a threaded stud at the rear end of the mounting portion thereof, and some portion of the tool has a non-circular cross section which mates with a complementary non-circular portion of the mounting block such that the tool is non-rotatably retained. When the tool is inserted into the mounting block of the machine, a lock nut is threaded to the stud to retain the stud in a cylindrical aperture extending through the mounting block. Typically, the lock nut has a radial hole extending through the wall of the nut with a plastic insert extending therethrough, and the plastic binds into the threads of the stud as the nut is tightened. As an alternative to a lock nut, some portion of the threads of the nut or stud may be damaged after a nut is assembled thereto such that the nut cannot subsequently be removed without the application of substantial torque. When lock nuts or damaged threads are used to retain the tool, the tool must be non-rotatably mounted so as to resist the large torque required to remove a nut having a plastic insert, or a nut for which the threads have been damaged.

Presently, such tools have a cylindrical mounting a portion and a tapered forward end, and some portion of the tool has a non-circular cross section, such as a flat. The mounting block, on the other hand, has a cylindrical aperture to retain the mounting portion of the tool and a forward portion has a complementarily shaped section which engages the non-circular portion of the tool.

There are certain drawbacks to the currently used methods of mounting tools into a mounting block of a cutting machine. Where the tool has a portion with a non-circular cross section, such as a flat, which engages a complementarily shaped portion of the mounting block, such as a ridge, the tool can be inserted in only a finite number of orientations. This structure increases the installation time for mounting such tools onto machines, and increase the manufacturing costs of both the tool and the mounting block.

Another problem with existing non-rotatable tools is that the anti-rotation device is typically a ridge on the forward surface of the block which engages a flat on the outer circumference of the tool. The metal from which the block and anti-rotation ridge are cast or forged, however, is relatively soft and is subject to being washed away by friction as the particles broken free by the tool are removed from the proximity of the cut. Over a period of time, the anti-rotation ridge on the block will become entirely washed away, thereby rendering the block unusable for receiving another tool.

It would be desirable, therefore, to provide for the mounting of a tool within a machine which is completely symmetrical about its longitudinal axis, but would be non-rotatable during use. Furthermore, it would be desirable to have a mounting nut which would not loosen as a result of vibration, but could be loosened and reoriented to a different angle chosen by the operator.

As an alternative to the above, it would be desirable to provide a means for preventing the anti-rotation device on the mounting block from being washed away.

SUMMARY OF THE INVENTION

Briefly, the present invention is embodied in a tool mounting block having a forward surface and a rearward surface and a cylindrical transverse aperture extending therethrough opening onto both the forward and rearward surfaces. The transverse opening in the mounting block is for receiving the cylindrical mounting portion of a tool. The tool has a tapered forward cutting end, and axially aligned behind the forward cutting end is an annular flange. Axially aligned behind the annular flange is a cylindrical mounting portion adapted to slidably fit within a complementarily cylindrical aperture of the mounting block, and extending rearward of the cylindrical mounting portion is a threaded stud. At the forward end of the tapered cutting end is a seat into which a hardened metal insert is bonded.

To retain the cylindrical mounting portion of the tool within the cylindrical aperture of the mounting block, a locking nut assembly is threaded on the stud. The locking nut assembly has a first threaded portion and a second non-threaded portion and is assembled onto the stud with the non-threaded portion positioned between the rearward surface of the mounting portion of the tool and the forward surface of the first threaded portion of the nut. The second non-threaded portion has a forward surface which abuts against a portion of the rearward end of the cylindrical mounting portion of the tool, and a rearward surface which engages a forward surface of the threaded portion of the nut.

The forward surface of the first portion of the nut, and rearward surface of the second portion of the nut each define at least one spiral ramp which extends around the axis of the stud in the same direction as the threads and has a rate of incline which is greater than the rate of incline of the threads of the stud.

When a tool is retained in a mounting block by such a nut assembly, the nut may be tightened to prevent rotation of the tool within the mounting block. The threaded portion of the nut will compress the non-threaded portion against the rear surface of the mounting block.

In accordance with the present invention, the frictional resistance between the forward surface of the second non-threaded portion of the nut and the rearward surface of the mounting block is greater than the frictional resistance between the threaded stud and the first threaded portion of the nut. Accordingly, any rotation caused by vibration of the assembly will tend to cause the loosening of the threaded portion of the nut from the stud. Since the ramp surfaces of the first and second portions of the nut are at an incline greater than the ramp of the threads, the rotation of the first threaded portion with respect to the second non-threaded portion of the nut will cause the threaded portion of the nut to become more tightly compressed against the non-threaded portion and thereby prevent further rotation thereof.

The threaded portion and non-threaded portion of the nut both have hexagon cross sections such that they can be assembled and disassembled onto the stud of a tool as a unit.

The nut may be released by rotating the threaded and non-threaded portions simultaneously using a conventional wrench. The nut can be released and thereafter retightened, such that the technician can choose the orientation of the tool within the mounting block and lock the tool into the desired orientation.

In another embodiment of the invention, an anti-rotation device is provided between the block and the tool in the form of a ridge or a groove on the forward surface of the block which is engaged by a complementary ridge or groove on the inner surface of an annular flange of the tool. In this embodiment, a portion of the annular flange of the tool extends over the ridge or groove on the block such that particles loosened by the tool will not wear or wash away the metal forming the anti-rotation device on the block. The anti-rotation device will, therefore, not be eroded away during use of the tool, and in the event the tool must be replaced, the anti-rotation device of the block will receive the mating anti-rotation portions of a second unit.

BRIEF DESCRIPTION OF THE DRAWINGS

A better and more complete understanding of the present invention will be had after a reading of the following detailed description taken in conjunction with the following drawings wherein.

DETAILED DESCRIPTION OF THE PREFERRED EMBODIMENTS

Figure 2:
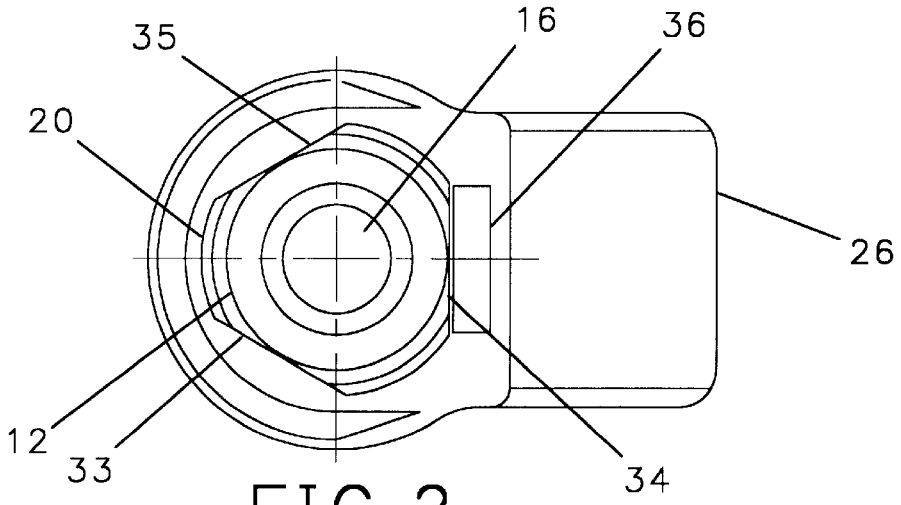
FIG.2 PRIOR ART
FIG. 2 is a front elevational view of the tool and block shown in FIG. 1.
Figure 1:
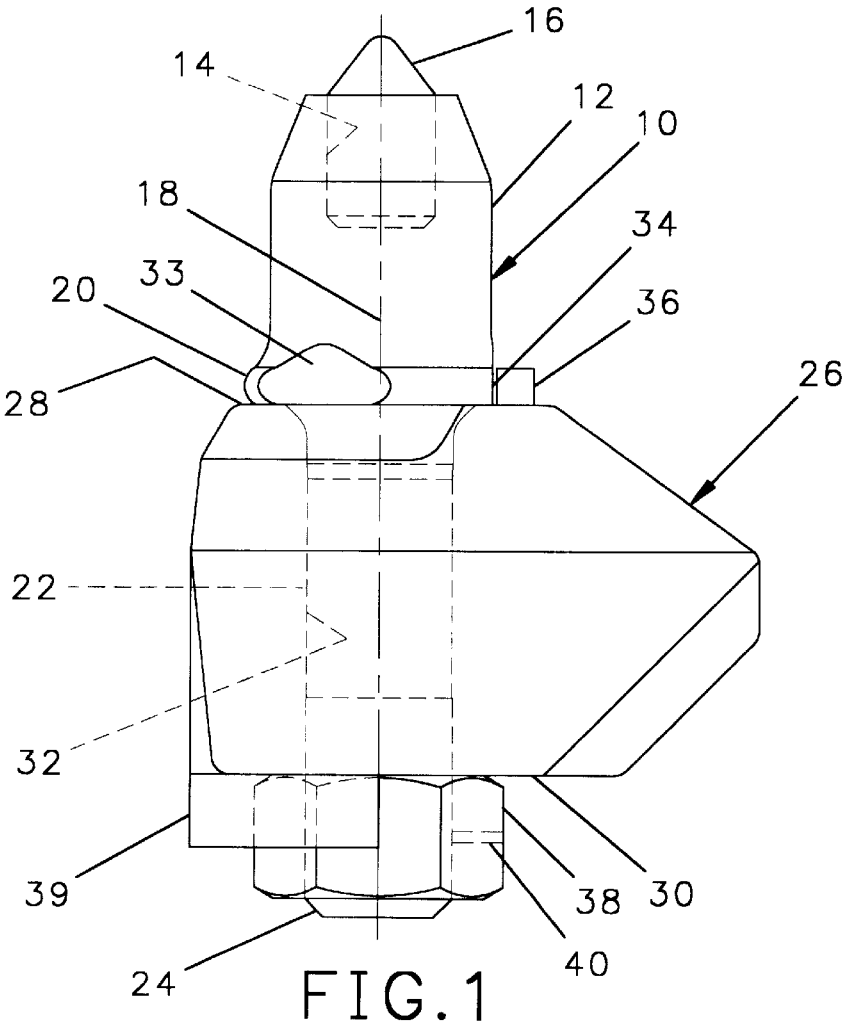
FIG.1 PRIOR ART
FIG. 1 is a side elevational view of a tool and block in accordance with the prior art with the interior portion of the block and nut shown in phantom lines.

Referring to FIGS. 1 and 2, in accordance with the prior art, a tool 10 has a tapered cutting end 12 at the forward end of which is a seat 14 into which is brazed a hardened insert 16. The tool 10 has a longitudinal axis 18 and positioned axially behind the tapered cutting end 12 is an annular radial flange 20. Disposed axially behind the flange 20 is a cylindrical mounting portion 22, and extending axially rearward of the mounting portion 22 is a threaded stud 24.

The tool 10 is retained in a mounting block 26 having a forward surface 28, a rearward surface 30, and an aperture 32 extending transversely through the block and opening into both the forward and rearward surfaces 28, 30, respectively. The cylindrical aperture 32 has a diameter which is a little larger than the diameter of the cylindrical mounting portion 22 of the tool 10 so as to slidably receive the cylindrical mounting portion 22 therein. The flange 20 of the tool 10 further has a plurality of flats 33, 34, 35 such that the outer perimeter of the flange 20 is not circular, and an alignment ridge 36 is welded to the mounting block 26 so that an inner surface thereof can engage one of the flats 34 to form an anti-rotation device preventing rotation of the tool 10 within the aperture 32.

To retain the mounting portion 22 of the tool 10 within the aperture 32, a lock nut 38 is threaded onto the stud 24, and the outer diameter of the lock nut 38 is larger than the inner diameter of the aperture 32 such that a portion of the lock nut 38 will engage the rearward surface 30 of the block. The lock nut 38 is depicted as having a transverse bore which is filled with a plastic insert 40 or it may have a deformed internal thread (not shown) for binding against the threads of the stud 24 to prevent removal of the nut 38. Extending around a portion of the stud 24 and a portion of the nut 38 is a U-shaped shroud 39 which is welded to the lower surface 30 of the mounting block 26.

The engagement of one of the flats 33, 34, 35 with the ridge 36 retains the tool 10 against rotation within the aperture 32 such that the nut 38 can be threaded onto or off of the stud 24 for the installation or removal of the tool. The manufacturer of the parts, however, requires the machining of the flats 33, 34, 35 on the tool 10 and the welding of the ridge 36 to the block. Furthermore, the block 26 will only receive the tool 10 when the tool is oriented with one of the flats 33, 34, 35 positioned to fit against the ridge 36, and except for the orientations permitted by the flats 33, 34, 35, the tool cannot be re-oriented by a technician who seeks to rotate the tool within the block 26 to compensate for any uneven wearing so as to increase the useful life of the tool.

Existing anti-rotation devices have a portion thereof on the forward surface of the block, such as the ridge 36 depicted in FIGS. 1 and 2 which engages a flat 33, 34, 35 on the tool 10. Such existing anti-rotation devices are exposed to being worn or washed away by particles of hard material loosened by the tool and moving around the block 26. It should also be appreciated that although the tool has a hardened cutting insert 16, the metal of the body of the tool 10 and of the block 26 are cast or forged and are much softer than the insert 16. The tools 10 are normally rendered unusable as a result of either the wear to insert 16, or the wash away of the body of the metal of the tool 10 and the block 26. The anti-rotation device 36 on the forward surface 28 of the tool block is especially susceptible to wash away, and once it has been washed away, a replacement tool 10 cannot be inserted into the block 26.

Figure 3:
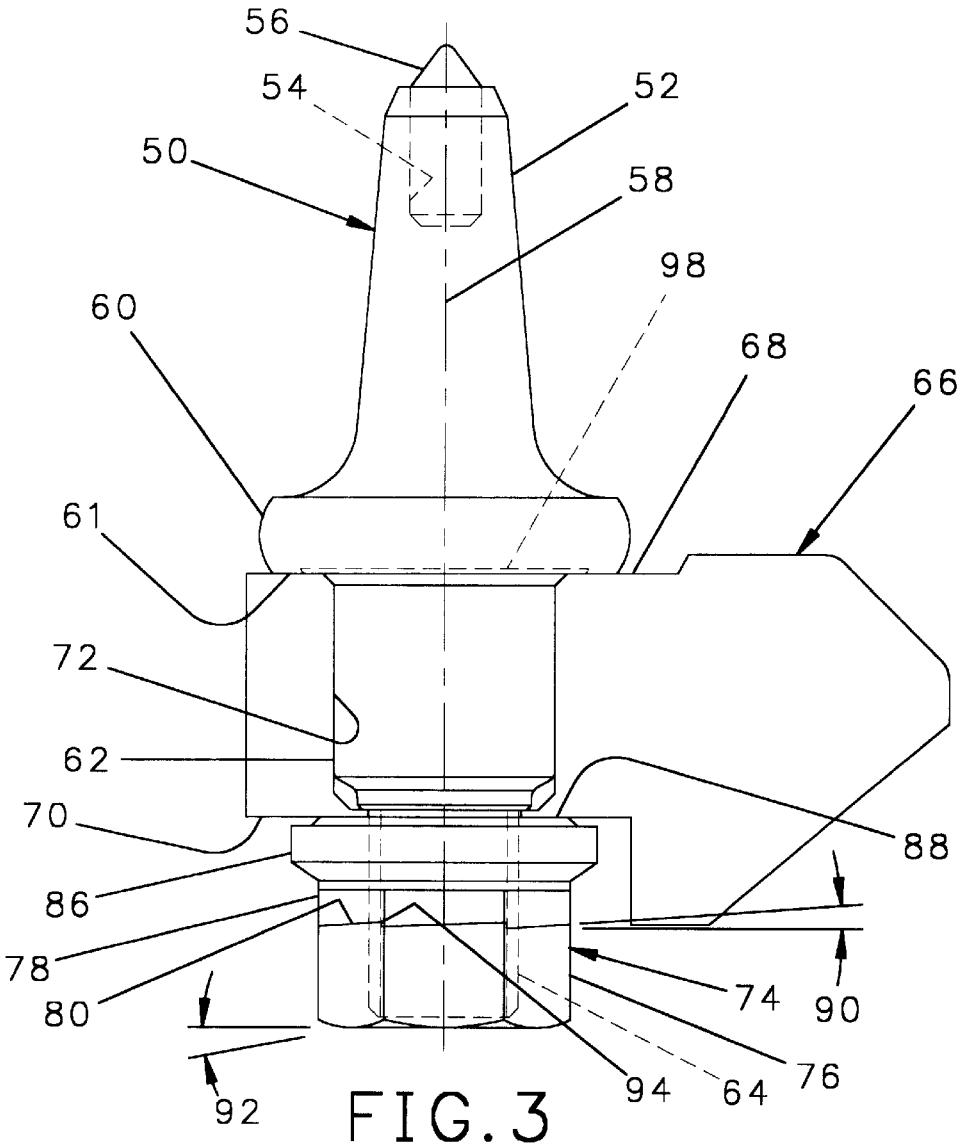
FIG. 3 is a cross-sectional view of a tool and block in accordance with the present invention.
Figure 4:
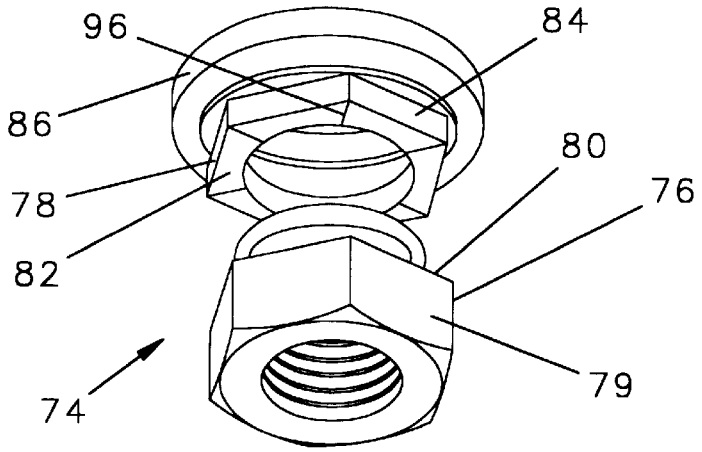
FIG. 4 is an exploded isometric view of a nut assembly for retaining the tool to the block in accordance with the embodiment shown in FIG. 3.

Referring to FIGS. 3 and 4, a tool 50 in accordance with the present invention has a tapered cutting end 52 at the forward end of which is a seat 54 into which is brazed hardened insert 56. The tool 50 is completely symmetrical about a longitudinal axis 58 such that any cross-section of the tool 50 taken perpendicular to the axis 58 is a circle. Axially disposed behind the tapered cutting end 52 is an annular flange 60 having a rearwardly facing contact surface 61. Axially disposed behind the annular flange 60 is a cylindrical mounting portion 62, and extending rearward of the cylindrical mounting portion 62 is a threaded stud 64.

The tool 50 is retained in a mounting block 66 having a forward surface 68 and a rearward surface 70. Extending through the mounting block 66 and intersecting both the forward surface 68 and rearward surface 70 is a cylindrical aperture 72 sized to slidably receive the cylindrical mounting portion 62 of the tool 50.

In accordance with the present invention, to retain the tool 50 within the mounting block 66 a retaining nut assembly 74 is provided. As best shown in FIG. 4, the retaining nut assembly 74 has a first threaded portion 76 and a second unthreaded portion 78, with the unthreaded portion 78 retained on the stud 64 between the threaded portion 76 and the rearward end of the mounting portion 62.

The first threaded portion 76 has a hexagonal outer surface 79 and a forward first surface 80. The second, unthreaded, portion 78 has a rearward facing second surface 82 which engages the first surface 80 of the threaded portion 76. The outer surface 84 of the second portion 78 is hexagonal with dimensions equal to the outer surface 79 of the first portion 76 such that a wrench can be-sized to simultaneously grasp the hexagonal outer surfaces of the two portions 76, 78. Forward of the hexagonal surface 84 is a radially extending annular flange 86 having a forward oriented third surface 88. The diameter of the annular flange 86 is greater than the inner diameter of the aperture 72 such that a portion of the third surface 88 engages a portion of the rearward facing surface 70 of the block 66 to thereby retain the tool 50 within the aperture 72 of the block.

In accordance with the present invention, the first surface 80 of the threaded portion 76 and the second surface 82 of the second portion 78 are ramped, and both ramped surfaces have an angle of incline 90 which is greater than the angle of incline 92 of the threads of the studs 68 and the ramps spiral around the axis of the portions 76, 78 in the same direction as the threads of stud 64. The ramped surface 80 is broken by one or more steps 94 and the ramped surface 82 is complementarily broken by one or more steps 96. Also, the diameter of the flange 86 is sufficiently large such that the frictional resistance between the third surface 88 and the rearward surface 70 is greater than the frictional resistance between the inner threads of the threaded portion 76 and those of the stud 64. Similarly, the frictional resistance between the forward surface 68 of the block and the contact surface 61 of the tool 50 is greater than the frictional resistance between the threads of the threaded portion 76 and the stud 64. Since the frictional resistance between the surfaces 88, 70 and the surfaces 68, 61 are greater than the frictional resistance which retains the nut to the stud, vibration between the parts will result in rotation of the threaded portion 76 with respect to the stud 64 before the unthreaded portion 78 is caused to rotate with respect to the block 66 or the tool 50 is caused to rotate with respect to the mounting block 66. Accordingly, any vibration which will tend to cause rotation and loosening of the nut 74 will first cause rotation of the threaded portion 76 and movement of the ramp of the first surface 80 with respect to the ramp of the second surface 82. Since the angle of inclination 90 of the ramp surfaces 80, 82 is greater than the angle of inclination 92 of the threads, movement of the first surface 80 with respect to the second surface 82 will increase the axial forces on the unthreaded portion 78, thereby tightening the threaded portion 76. The increased axial forces and tightening of the threaded portion 76 further increases the friction between the surfaces 80, 82 and 88, 70 to thereby prevent further rotation of the parts with respect to the stud 66. The mounting portion 66 of the tool 50 will thereby be retained within the aperture 72 of the mounting block 56 and will not be loosened by vibration.

A tool 50 assembled to a block 66 in accordance with this embodiment of the invention will not require the provision of a flat and ridge or other configurations whereby the tool 50 is locked against rotation. Since the frictional resistance between the surfaces 88, 70 is greater than the frictional resistance between the threads of the threaded portion 76 and the stud 64, the retaining nut assembly 74 can be installed and removed without causing rotation of the tool 50 within the block 66.

As can be seen in FIG. 3, the stud 64 at the end of the tool 50 has an axial length which does not exceed the axial length of the nut assembly 74 and, therefore, the distal end of the stud 64 is not exposed to wear away as is the distal end of the stud 24 of the prior art.

Figure 7:
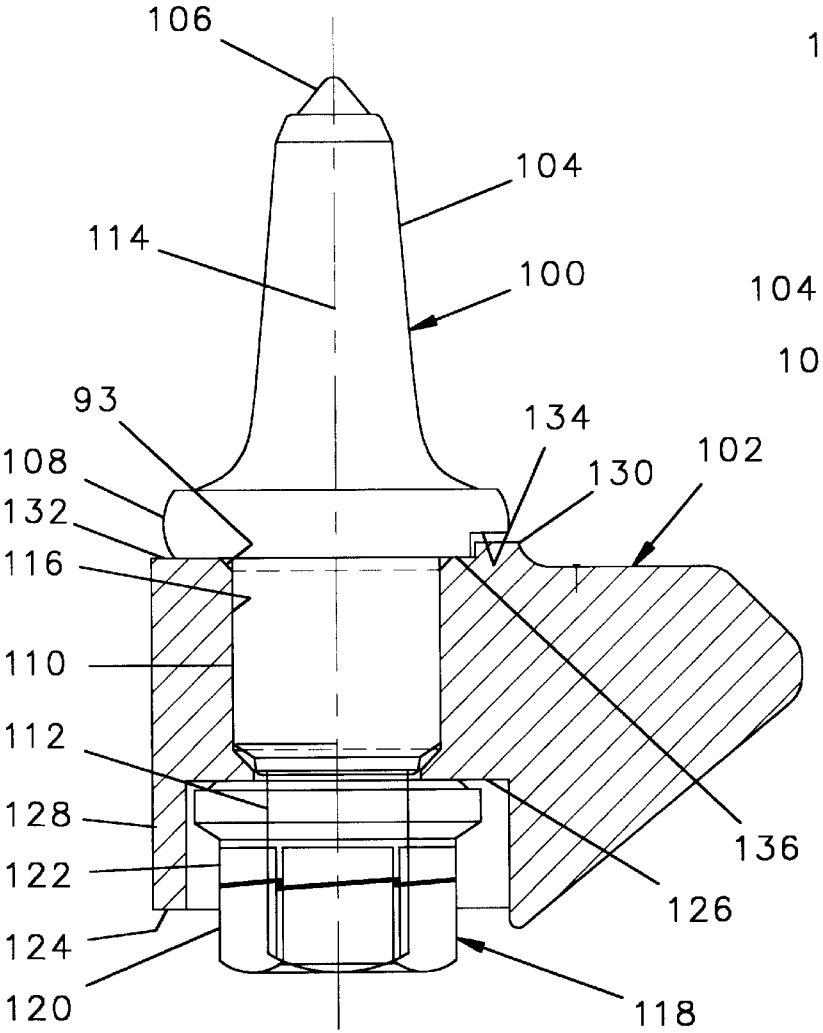
FIG. 7 is a cross-sectional view of a block with a tool and nut assembled thereto in accordance with a third embodiment of the invention.

The tool 50 of the present invention can be adapted to further resist rotation within the block 66 by the provision of an annular undercut 98 on the contact surface 61 of the flange 60. The undercut 98 has an inner diameter equal to the outer diameter of the cylindrical mounting portion 62 and an outer diameter which is substantially less than the outer diameter of the annular flange 60. The undercut 99 insures that the outer portion of the contact surface 61 of the flange 60 engages the forward surface 68 of the block 66 so there will be the required friction between the parts. In the absence of the undercut 98, or of a countersink as shown in FIG. 7 at 93, any fillet between the cylindrical surface 62 and the contact surface 61 of the flange 60 may engage the outer end of the aperture 72 and thereby space the contact surface 61 from the forward surface 68 of the block 66, so as to reduce the friction between these parts. Currently, a countersink 93 is used to insure contact between the surfaces.

The provision of hexagonal outer surfaces 79, 84 of the first and second portion 76, 78, respectively, permits a technician to assemble the retaining nut 74 to the stud 64 with the ramped surfaces 80, 82 in engagement with each other and with the step 94, 96 adjacent each other to thereby maximize the tightening potential of the retaining nut assembly 74 once it is assembled to the stud 64.

It should be appreciated that the nut assembly 74 described above cannot always be freely assembled to the stud 64 of the tool 50. Therefore, it may be desirable to provide an anti-rotation device between the tool 50 and the block 66 even when a nut assembly 74 is provided to retain the tool 50 to the block 66.

Figure 6:
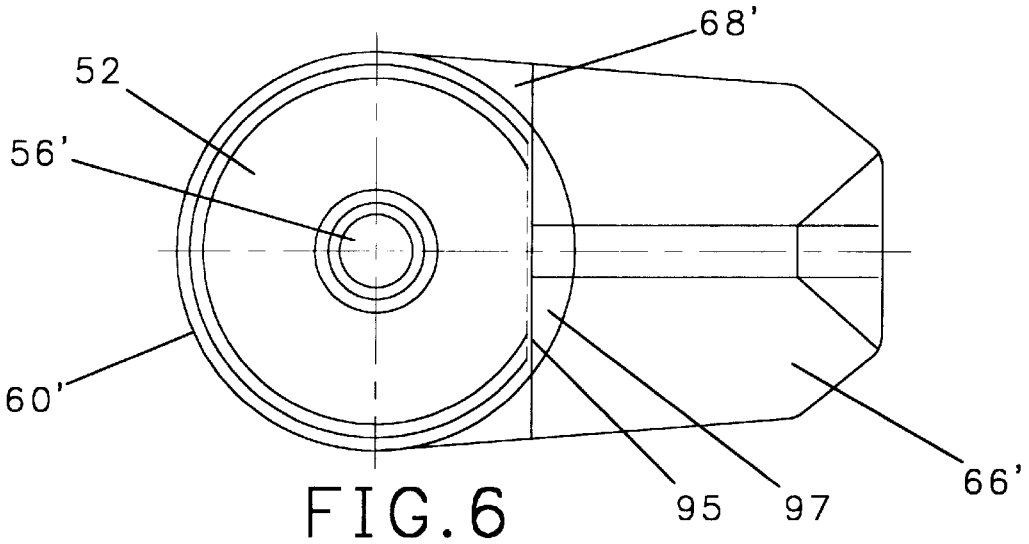
FIG. 6 is a front elevational view of the embodiment shown in FIG. 5.
Figure 5:
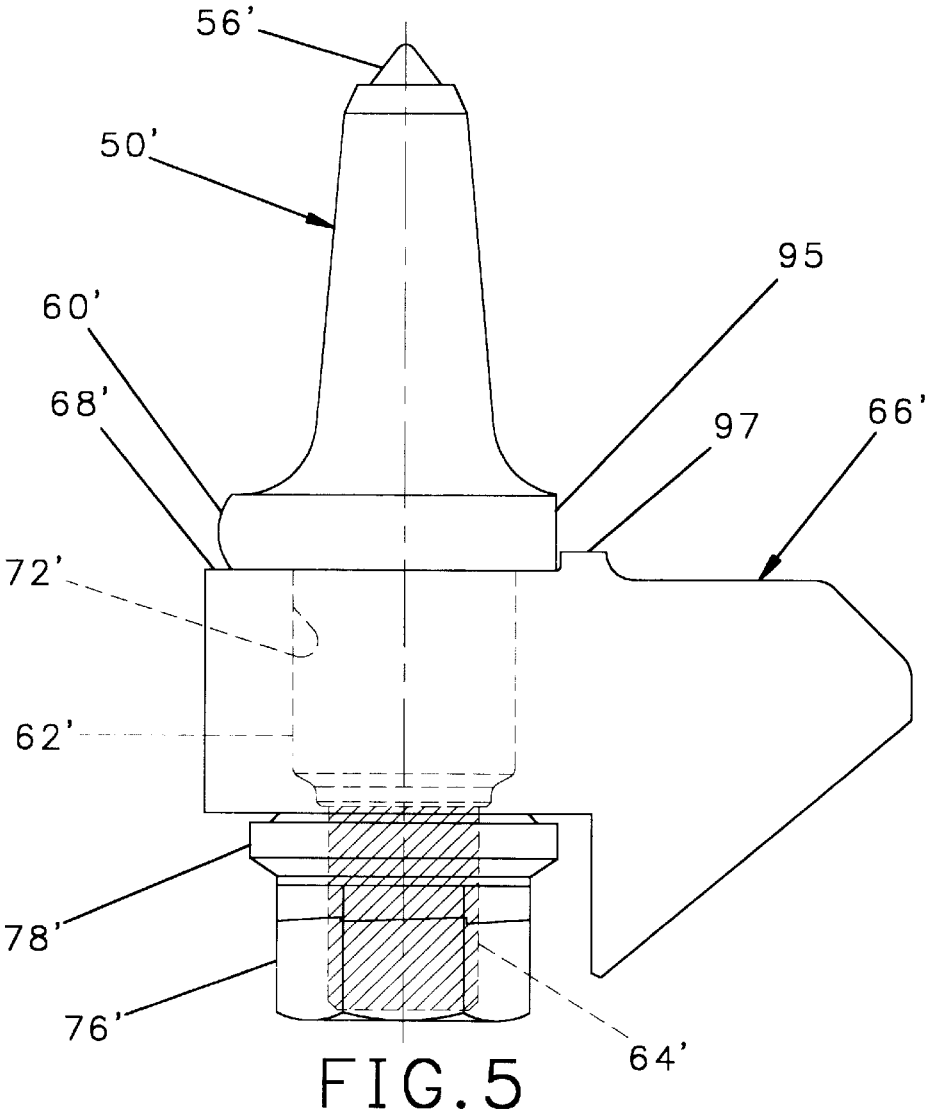
FIG. 5 is a side elevational view of a second embodiment of the present invention with the inner portions of the block and nut shown in phantom lines.
Figure 8:
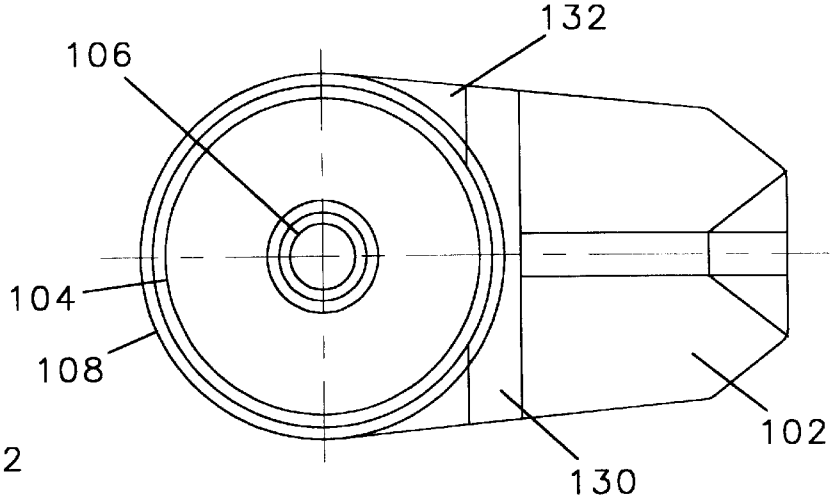
FIG. 8 is a front elevational view of the embodiment shown in FIG. 7.

FIGS. 5 and 6 disclose an embodiment of a tool 50' which is similar to the first embodiment in which like elements bear like indicia numbers except they are primed. This embodiment incorporates an anti-rotation device in the form of a flat 95 on the flange 60' of the tool 50' and a ridge 97 forged or machined into the forward surface 68' of the mounting block 66'. In all other respects, the embodiment depicted in FIG. 6 is identical to the first embodiment of the tool 50 and mounting block 66.

Referring to FIGS. 6 and 7 in which another embodiment of a tool 100 and a mounting block 102 is depicted. As in the first embodiment, the tool 100 has a tapered cutting end 104 at the forward end of which is a hardened insert 106 brazed into a seat, not shown. The tool 100 also has a radial flange 108 positioned axially behind the cutting end 104, a cylindrical mounting portion 110 positioned axially behind the radial flange 108, a threaded stud 112 positioned axially behind the mounting portion 110, and a longitudinal axis 114. The mounting portion 110 extends through a cylindrical aperture 116 in the block 102 and is retained therein by a retaining nut assembly 118 having a threaded portion 120 and an unthreaded portion 122 identical to that described with respect to the nut assembly 74 of the first embodiment.

In this embodiment, the rearward surface 124 of the block 102 has a counterbore 126 having a diameter which is greater than the diameter of the retaining nut assembly 118, and sufficiently large to accept a hex socket of a wrench to fit around the nut assembly 118. As shown, the counterbore 126 is deeper than the thickness of the unthreaded portion 122 of the assembly. When the tool 100 is retained by the assembly 118 with the mounting portion 110 extending through the aperture 116, as shown, a portion of the assembly 118, including the juncture between the two portions 120, 122 thereof, will be protected from wash away damage during use by a wall 128 formed by a portion of the block 102 extending around the counterbore 126. The 360 degree protection to the assembly 118 provided by the counterbore 126 is more effective in preventing damage to the assembly 118 than the shroud of the type shown in the prior art. In the absence of the counterbore 126, granular particles may enter between the rear surface of the block 102 and the nut assembly 118 and the portions 120, 122 of the assembly 118.

Also, to facilitate the attachment of the nut assembly 118 to the stud 112, the tool 100 and block 102 is provided an anti-rotation device in the form of a ridge 130 forged or machined into the forward surface 132 of the block and one or more grooves 134 cut across a cord in the rear surface 136 of the radial flange 108 to mate with ridge 130 as shown. Unlike the welded ridge as shown in the anti-rotation devices of the prior art, the ridge 130 of the present invention is protected from wash away by a portion of the flange 108 which remains after the groove 134 has been cut therein.

While several embodiments of the present invention have been shown and described, it will be apparent to those skilled in the art that many other changes and modifications may be made without departing from the true spirit and scope of the present invention. It is the intent of the appended claims to cover all such changes and modifications which fall within the true spirit and scope of the invention.

What is claimed:

1. A tool and mounting comprising in combination, a tool mounting block having a forward surface, a rearward surface, and a transverse aperture extending from said forward surface to said rearward surface, a tool body having a forward cutting end, an annular flange axially aligned behind said forward end, and a mounting portion axially aligned behind said annular flange, said tool body having a seat at a forward end of said cutting end, and having a principal longitudinal axis, a hardened metal insert bonded into said seat, said mounting portion having a threaded stud extending axially from a rear end thereof, said threads of said stud having a given rate of incline, said mounting portion of said tool positioned in said aperture with said annular flange in engagement with said forward surface, a locking nut on said threaded stud for retaining said mounting portion in said mounting block, said locking nut having a first threaded portion sized to receive threads of said threaded stud, and a second unthreaded portion, said first threaded portion having a first surface, and said threads thereof having a given rate of incline, said second unthreaded portion having a second surface and a third surface, said second surface in engagement with said first surface, and said third surface in engagement with said rearward surface of said mounting block, said first surface and said second surface having a spiral ramp, said spiral ramps of said first surface and said second surface having rates of incline greater than said given rate of incline, and said third surface having a diameter greater than said given diameter of said aperture.

2. A tool and mounting in accordance with claim 1 wherein, said engagement between said third surface and said rear surface has a first frictional resistance therebetween, said engagement between said flange and said forward surface has a second frictional resistance therebetween, and the engagement of said threaded nut and said stud has a third frictional resistance therebetween which is less than either of said first and said second frictional resistances.

3. A tool and mounting in accordance with claim 1 and further comprising, anti-rotation means on a rearward surface of said annular flange and on said forward surface of said mounting block whereby a portion of said annular flange extends over at least a portion of said anti-rotation means on said forward surface.

4. A tool and mounting in accordance with claim 1 wherein said anti-rotation means comprises a ridge on one of said forward surface and said rearward surface and a groove on the other of said surface and said rearward surface.

5. A tool and mounting in accordance with claim 1 wherein said locking nut has an axial length greater than the length that said stud extends below said lower surface such that the distal end thereof does not extend below said locking nut.

6. A tool and mounting in accordance with claim 1 and further comprising, said annular flange having a contact surface for engaging a forward surface of said mounting block, and said annular flange having an undercut between said contact surface and said mounting portion.

7. A tool and mounting in accordance with claim 1 and further comprising a countersink in said rear surface of said block for receiving a portion of said locking nut to thereby protect said locking nut.

8. A tool for mounting in a tool mounting block of the type having a forward surface, a rear surface, and a transverse aperture extending from said forward surface to said rearward surface, said cylindrical aperture having a given diameter, said tool comprising, a tool body having a forward cutting end, an annular flange axially aligned behind said forward end, and a mounting portion axially aligned behind said annular flange, said annular flange having a diameter greater than said given diameter of said aperture, said tool body having a seat at a forward end of said cutting end, and having a principal longitudinal axis, a hardened metal insert bonded into said seat, said mounting portion having a threaded stud extending axially from a rear end thereof, said threads of said stud having a given rate of incline, a locking nut on said threaded stud for retaining said mounting portion in said aperture of said mounting block, said locking nut having a first threaded portion sized to receive threads of said threaded stud, and a second unthreaded portion, said first threaded portion having a first surface, said second unthreaded portion having a second surface and a third surface, said second surface for engagement with said first surface, and said third surface for engagement with said rearward surface of said mounting block, said first surface and said second surface having a spiral ramp, said spiral ramps of said first surface and said second surface having a rate of incline greater than said given rate of incline, said third surface having a diameter greater than said given diameter of said aperture.

9. A tool in accordance with claim 8 wherein said tool body is completely symmetrical about said principal longitudinal axis.

10. A tool in accordance with claim 8 and further comprising, said annular flange having a contact surface for engaging a forward surface of said mounting block, and said annular flange having an undercut between said contact surface and said mounting portion.

11. A tool and mounting comprising in combination, a tool mounting block having a forward surface, a rearward surface, and a transverse cylindrical aperture extending from said forward surface to said rearward surface, a tool body having a forward cutting end, an annular flange axially aligned behind said forward end, and a cylindrical mounting portion axially aligned behind said annular flange, said annular flange having a rearward surface, said tool body having a seat at a forward end of said cutting end, and having a principal longitudinal axis, a hardened metal insert bonded into said seat, said cylindrical mounting portion having a threaded stud extending axially from a rear end thereof, said threads of said stud having a given rate of incline, said mounting portion of said tool positioned in said cylindrical aperture with said rearward surface of said annular flange in engagement with said forward surface, a nut on said threaded stud for retaining said cylindrical mounting portion in said mounting block, anti-rotation means on said rearward surface of said annular flange and said forward surface of said tool mounting block, whereby a portion of said annular flange extends over at least a portion of said anti-rotation means on said forward surface.

12. A tool and mounting in accordance with claim 11 wherein said anti-rotation means comprises a ridge on one of said rearward surface of said annular flange and said forward surface of said mounting block, and a mating groove on the other of said rearward surface of said annular flange and said forward surface of said block.

13. A tool and mounting in accordance with claim 12 and further comprising a countersink in said rear surface of said block for receiving a portion of said nut to thereby protect said nut.

14. A tool and mounting in accordance with claim 13 wherein said nut has a height greater than the length of said stud which extends below said lower surface such that the distal end thereof does not extend below said nut.

15. A tool and mounting in accordance with claim 14 and further comprising, said annular flange having a contact surface for engaging a forward surface of said mounting block, and said annular flange having an undercut between said contact surface and said mounting portion.

16. A tool and mounting in accordance with claim 15 wherein said nut is a locking nut comprising, a first threaded portion sized to receive threads of said threaded stud, and a second unthreaded portion, said first threaded portion having a first surface, and said threads thereof having a given rate of incline, said second unthreaded portion having a second surface and a third surface, said second surface in engagement with said first surface, and said third surface in engagement with said rearward surface of said mounting block, said first surface and said second surface having a spiral ramp, said spiral ramps of said first surface and said second surface having rates of incline greater than said given rate of incline, and said third surface having a diameter greater than said given diameter of said aperture.

17. A tool and mounting in accordance with claim 11 and further comprising a countersink in said rear surface of said block for receiving a portion of said nut to thereby protect said nut.

18. A tool and mounting in accordance with claim 11 wherein said nut has a height greater than the length of said stud extending below said lower surface such that the distal end thereof does not extend below said nut.

19. A tool and mounting in accordance with claim 11 and further comprising, said annular flange having a contact surface for engaging a forward surface of said mounting block, and said annular flange having an undercut between said contact surface and said mounting portion.

* * * * *

UNITED STATES PATENT AND TRADEMARK OFFICE

CERTIFICATE OF CORRECTION

PATENT NO. : 5,992,405
DATED : November 30, 1999
INVENTOR(S) : Phillip A. Sollami It is certified that error appears in the above-identified patent and that said Letters Patent is hereby corrected as shown below:

Column 1,
Line 41, after "mounting" delete "a".
Line 55, after "and" delete "increase" and substitute -- increases --.

Column 6,
Line 47, after "FIGS" delete "6" and substitute -- 8 --.

Column 10,
Line 3, after "Claim" delete "12" and insert -- 11 --.
Line 7, after "claim" delete "13" and substitute -- 11--.
Line 9, after "stud" delete "which extends" and substitute -- extending --.
Line 18, after "claim: delete "15" and substitute -- 19 --.
Line 37, after "claim" delete "11" and substitute -- 12 --.
Line 41, after "claim" delete "11" and substitute -- 17 --.
Line 43, after "stud" delete "extends" and substitute -- which extends --.
Line 45, after "claim" delete "11" and substitute -- 18 --.

Signed and Sealed this

Fourth Day of September, 2001

*Attest:*

Nicholas P. Godici

NICHOLAS P. GODICI
*Acting Director of the United States Patent and Trademark Office*

*Attesting Officer*